United States Patent [19]

Warnod

[11] 4,116,158

[45] Sep. 26, 1978

[54] VIBRATING MEMBRANE HORNS

[75] Inventor: Bertrand Antoine Warnod, Neuilly, France

[73] Assignee: Klaxon S.A., Courbevoie, France

[21] Appl. No.: 852,381

[22] Filed: Nov. 17, 1977

Related U.S. Application Data

[63] Continuation of Ser. No. 721,930, Sep. 15, 1976, abandoned.

[30] Foreign Application Priority Data

Sep. 18, 1975 [FR] France ..... 75 28544

[51] Int. Cl.[2] ..... G10K 9/00

[52] U.S. Cl. ..... 116/142 R; 340/388

[58] Field of Search ..... 116/142 R, 142 FV, 142 FP; 427/245, 290, 417; 340/388

[56] References Cited

U.S. PATENT DOCUMENTS

| | | | |
|---|---|---|---|
| 1,257,863 | 2/1918 | Hesselbein | 116/142 R X |
| 2,003,505 | 6/1935 | Gillet | 116/142 FV |
| 2,575,577 | 11/1951 | Beauchamp | 427/245 X |
| 2,826,509 | 3/1958 | Sarbach | 427/245 |

FOREIGN PATENT DOCUMENTS

| | | | |
|---|---|---|---|
| 342,711 | 10/1921 | Fed. Rep. of Germany | 116/142 FP |

*Primary Examiner*—Daniel M. Yasich

*Attorney, Agent, or Firm*—Nolte & Nolte

[57] ABSTRACT

Vibrating membrane horn of the type wherein a membrane is applied on a peripheral flange on a case in such a way as to close said case. Said case contains a vibrations generator acting on said membrane and a gasket is interposed between said membrane and said flange. Said gasket consists of an absorbent material impregnated with a water-proofing product.

6 Claims, 3 Drawing Figures

VIBRATING MEMBRANE HORNS

This is a continuation of application Ser. No. 721,930, filed Sept. 15, 1976, now abandoned.

The invention relates to horns with a vibrating membrane subjected to the action of an electro-magnetic vibrations generator, said membrane being applied on a flange surrounding a case in such a way as to close said case.

Horns of this kind are fitted on vehicles, particularly automotive vehicles, and are therefore subjected to widely varying climatic conditions. For example, they can be used at a high altitude where ambient pressure decreases so that it is necessary to provide means of outlet for the air contained in the housing so that the pressure inside the housing can balance with ambient pressure so that the membrane and the vibrations generator operate in the conditions for which they have been set. This possibility for the air to pass is also essential to compensate temperature variations resulting from external variations and/or the proximity of a thermal engine However, such horns must also be water-tight since water penetrating and remaining inside the case, in contact with the vibrations generator, brings a risk of damage and causes a change in the horn's sound.

To solve this problem of water-tightness, a gasket, e.g. made of paraffin paper or glass paper, is sometimes added to the flange. The use of such gaskets does not, however, make it possible simultaneously to solve the problem of water-tightness and the problem of air passage. It has therefore been proposed to make the connection between the membrane and the case completely tight both to water and air and to provide a completely water-tight communication with the ambient air in the housing.

This latter solution, while it is satisfactory from a technical point of view, complicates manufacture and increases the cost price.

The invention aims to overcome this disadvantage by means of a new gasket which is completely water-tight but nevertheless allows air to pass.

To this end, the subject-matter of the invention is a vibrating membrane horn of the type wherein a membrane is applied on a peripheral flange on a case in such a way as to close said case, said case containing a vibrations generator acting on said membrane, a gasket being interposed between said membrane and said flange, the horn being characterised by the fact that said gasket consists of an absorbent material impregnated with a water-proofing product. The absorbent material advantageously consists of blotting paper, filter paper or felt. The water-proofing product can be a product for water-proofing textiles, a siliconised product, etc.

The invention also covers a method of manufacturing a gasket for a horn.

The applicant has carried out a great deal of research relating to the draconian test conditions for horns laid down by car manufacturers. These conditions basically relate to performance under temperature and pressure variations and immersion in water, tests on these characteristics not being carried out independently of one another.

As has previously been indicated, this research has revealed that none of the gaskets used up to now makes it possible to stand these tests without adding a special device to make the inside of the case communicate with the atmosphere.

The research carried out has shown, surprisingly, that the use of an absorbent base, preferably made of blotting paper, filter paper or felt, previously impregnated with a water-proofing agent, makes it possible to solve the problem without requiring any special component for the passage of air.

The gasket in accordance with the invention is manufactured by cutting out from the selected base a part in the shape of the gasket, immersing this part in a solution or a suspension of the water-proofing product, extracting the impregnated part from said product and finally drying the impregnated part. Drying can be carried out in the open air or by heating and/or increasing the pressure.

The product used can be any water-proofing agent, e.g. a textile water-proofing agent or a product based on silicones. This agent can be in suspension or in solution in a suitable liquid such as water, trichlorethylene, etc. The concentration of water-proofing agent makes it possible to adjust the quantity of this agent retained in the absorbent base and, consequently, the degree of permeability to air, in order precisely to meet the aforementioned test conditions.

An embodiment of this invention is illustrated in the accompanying drawings in which.

Figure 1:
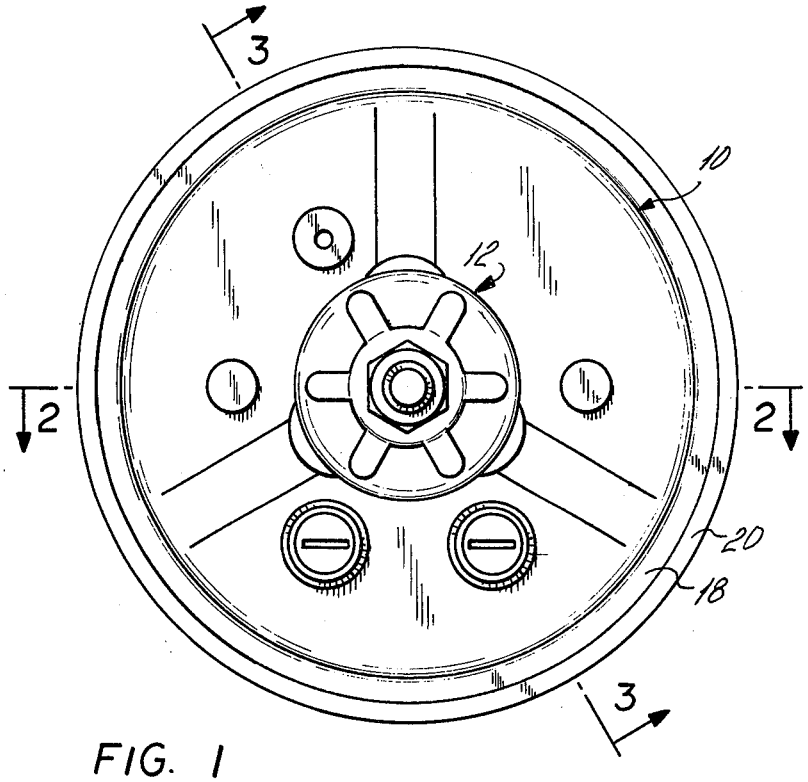
FIG. 1 is an elevational view of a horn according to this invention.
Figure 3:
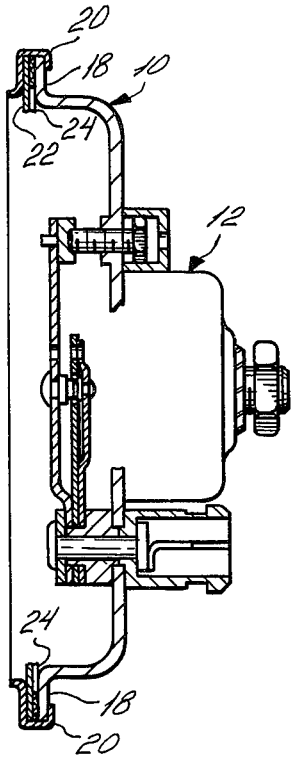
FIG. 3 is a section on the line 3—3 of FIG. 1.
Figure 2:
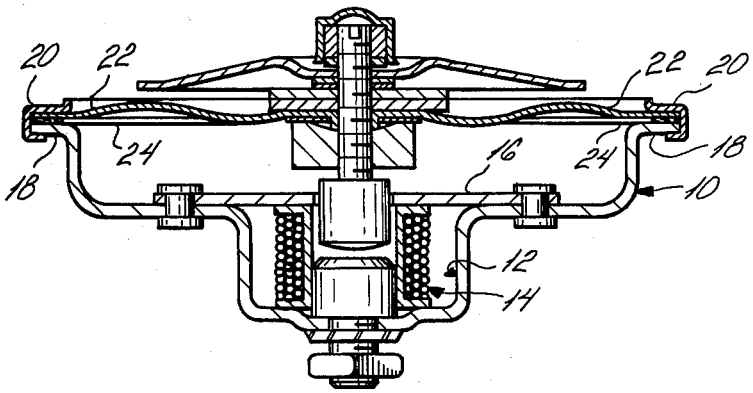
FIG. 2 is a section on the line 2—2 of FIG. 1.

The horn, illustrated in the drawings, is largely conventional and its operation is well know. For this reason a detailed description of the structure is not included herewith. Briefly, the horn comprises a case 10 defining a compartment 12 within which an electromagnetic vibration generator, indicated generally at 14, is disposed and which compartment is closed by a closure plate 16. The case has a peripheral radial flange 18 about its open end remote from compartment 12 and between that flange and a ring-like clamping element there is disposed a vibrating membrane 22 actuated by said electromagnetic vibration generator 14.

Disposed between the flange 18 and the peripheral edge region of membrane 22 is an annular gasket element 24. It is with this gasket that the present invention is concerned. The remaining elements of the horn are known and for this reason are not described in detail herein.

As discussed hereinbefore, the gasket 24 comprises an absorbent base of, for example, blotting paper, filter paper or felt, which has been impregnated with a water-proofing agent so that the gasket is effective to prevent the ingress of water past the outer peripheral edges of the membrane and into the enclosure defined by the membrane and by case 10. At the same time, the gasket is effective to allow the passage of air so that the pressure within the chamber defined by the membrane and the case 10 is equalized with ambient pressure outside that chamber.

It will readily be appreciated by those skilled in the art that several elements of the horn illustrated herein may be varied without deviating from the scope of this invention as defined in the appended claims.

What is claimed is:

1. A vibrating membrane horn of the type comprising a generally cup-shaped case having a peripheral flange extending about an open end of said case, a membrane extending across said open end of said case to close that case, a peripheral portion of said membrane being supported on said flange, a vibration generator disposed in said case and acting on said membrane, a gasket interposed between said membrane and said flange, said gasket being formed of an absorbent material impregnated with a water proofing product, and means clamping the peripheral portion of said membrane and said gasket to said flange, said case, said membrane and said clamping means defining a complete enclosure for said generator to which enclosure, the only access for air and water would be past the edge of said peripheral portion of said membrane, said gasket constituting means admitting air to the interior of the case past said peripheral portion substantially to equalize the pressure in the case with ambient pressure and precluding the ingress of water to the interior of the casing past said peripheral portion.

2. Horn in accordance with claim 1 wherein said absorbent material is blotting paper.

3. Horn in accordance with claim 1 wherein said absorbent material is filter paper.

4. Horn in accordance with claim 1 wherein said absorbent material is felt.

5. Horn in accordance with claim 1 wherein said water-proofing product is a product for water-proofing textiles.

6. Horn in accordance with claim 1 wherein said water-proofing product is a product based on silicones.

* * * * *